US006442765B1

(12) United States Patent
Fallon et al.

(10) Patent No.: US 6,442,765 B1
(45) Date of Patent: Sep. 3, 2002

(54) SAFETY HELMET

(76) Inventors: Vincent Fallon, Brick Cottages Studio, Shatters Road, Layer Breton, Essex CO2 0PY (GB); Richard John Albert Moore, Orchard House, 47 Old Newbridge Hill, Bath, Avon BA1 3LU (GB)

( * ) Notice: Subject to any disclaimer, the term of this patent is extended or adjusted under 35 U.S.C. 154(b) by 0 days.

(21) Appl. No.: 09/937,517

(22) PCT Filed: Mar. 24, 2000

(86) PCT No.: PCT/GB00/01017

§ 371 (c)(1),
(2), (4) Date: Sep. 25, 2001

(87) PCT Pub. No.: WO00/57739

PCT Pub. Date: Oct. 5, 2000

(30) Foreign Application Priority Data

Mar. 27, 1999 (GB) ..... 9906994

(51) Int. Cl.[7] ..... A42B 1/06
(52) U.S. Cl. ..... 2/410; 2/425; 2/421
(58) Field of Search ..... 2/410, 417, 425, 2/421

(56) References Cited

U.S. PATENT DOCUMENTS

| | | | | | |
|---|---|---|---|---|---|
| 2,861,272 | A | * | 11/1958 | Stuart et al. | 2/410 |
| 2,926,356 | A | | 3/1960 | Taylor | 2/3 |
| 3,500,473 | A | | 3/1970 | Marchello | 2/3 |
| 3,514,787 | A | * | 6/1970 | Kennedy, Jr. | 2/410 |
| 3,925,821 | A | | 12/1975 | Lewicki | 2/3 |
| 3,991,422 | A | * | 11/1976 | Saotome | 2/410 |
| 4,091,470 | A | * | 5/1978 | Ryunoshin | 2/410 |
| 4,607,397 | A | * | 8/1986 | Laxo | 2/410 |
| 4,827,537 | A | * | 5/1989 | Villa | 2/410 |
| 5,012,533 | A | * | 5/1991 | Raffler | 2/420 |
| 5,269,025 | A | * | 12/1993 | Broersma | 2/411 |
| 5,628,071 | A | * | 5/1997 | Nezer | 2/410 |
| 6,292,952 | B1 | * | 9/2001 | Watters et al. | 2/411 |

FOREIGN PATENT DOCUMENTS

| | | |
|---|---|---|
| DE | 1053195 | 3/1959 |
| EP | 0279086 | 8/1988 |
| EP | 0370696 | 5/1990 |
| EP | 0391389 | 10/1990 |

* cited by examiner

*Primary Examiner*—Rodney M. Lindsey
(74) *Attorney, Agent, or Firm*—Andrus, Sceales, Starke & Sawall, LLP

(57) ABSTRACT

A folding safety helmet intended primarily for use by a cyclist has a top panel (10) and a pair of similar side panels (11, 12), each panel (10, 11, 12) being made of a plastics material. Each side panel (11, 12) is separately pivoted at its two ends to the end regions (16, 17) of the top panel (10) and a pair of straps (13, 14) is arranged to limit the relative separation of the side panels with respect to the top panel. The side panels (11, 12) may be moved between an opened-out configuration where the helmet is ready for wear, and a folded position where the majority of the side panels lies within the confines of the top panel (10), so greatly reducing the volume of the helmet and facilitating its storage when not in use.

15 Claims, 9 Drawing Sheets

SAFETY HELMET

CROSS-REFERENCE TO RELATED APPLICATIONS

This application is the U.S. national stage application of International Application PCT/GB00/01017, filed Mar. 24, 2000, which international application was published on Oct. 5, 2000, as International Publication WO 00/57739 in the English language. The International Application claims priority of Great Britain Patent Application 9906994.0 filed Mar. 27, 1999.

This invention relates to a safety helmet and in particular—but not exclusively—to a safety helmet for use by cyclists.

Increasingly, riders of pedal cycles are wearing safety helmets, in order to give a degree of protection to the rider's head in the event of an accident. The usual form of safety helmet comprises a foamed plastics moulding having an outer skin of a tough plastics material and which often also is coloured or otherwise decorated. Such a helmet is relatively light to wear and gives some protection in the event of a low speed accident, but is of course quite unsuitable for use by motorcyclists, where speeds may be very much higher.

A cyclist's helmet is relatively bulky and so inconvenient to store or carry when it is not in use. This is a particular disadvantage in the case of a person who uses a bicycle for part of a journey and some other form of transport for another part of a journey; it is not practical for security reasons to leave the helmet with the bicycle and yet to carry the helmet when not riding the bicycle is very inconvenient. A typical helmet, for example, will not fit in a conventional form of briefcase or handbag due to its width, as predetermined by having to fit a user's head.

The above problem has already been addressed, for example in U.S. Pat. No. 5,628,071. The solution proposed therein however does not allow the manufacture of a commercial helmet meeting current safety criteria since the folding action described in that prior specification requires the use of relatively thin panels giving insufficient impact protection.

It is a principal aim of the present invention to provide a safety helmet which, by suitable selection of materials and construction, is capable of meeting all relevant safety standards for cyclists' helmets and yet which, when not in use, is not as bulky as a conventional cyclist's helmet, and which is thus relatively convenient to be stored or carried when not in use as a safety helmet.

According to the present invention, there is provided a safety helmet comprising a substantially rigid moulded plastics elongate curved top panel adapted to extend over the crown of a wearer's head from front to back, a pair of substantially rigid moulded plastics elongate side panels each adapted to extend around a respective side of a wearer's head, each side panel being separately pivoted at its two ends to the respective two ends of the top panel, the two pivotal connections of one side panel being displaced to one side of the centre-line of the top panel and the two pivotal connections of the other side panel being displaced to the other side of the centre-line of the top panel whereby the two side panels may be pivoted inwardly of the top panel so as lie mostly within a volume defined by the top panel, and strap means connected to the top panel and to each of the two side panels and adapted in use to extend under the chin of a wearer, the strap means serving to limit the relative separation of each of the two side panels from the top panel whilst permitting said inward pivoting of the side panels.

The safety helmet of this invention as described above is, in effect, foldable by relative pivoting of the panels. By allowing the two side panels to pivot inwardly towards the top panel, the overall volume of the folded helmet can be reduced to not much greater than that of the top panel itself. When so folded, the helmet is thus significantly less bulky than when opened out for wear. By appropriate dimensioning of the top and side panels, the helmet may be folded sufficiently to permit its easy storage for example in a briefcase or handbag, or in some other container or carrier.

In a preferred embodiment of safety helmet of this invention, the top panel has at its front end a front portion which, in use, partially extends over a wearer's forehead and at its rear end a rear portion which at least partially overlies the back of a wearer's head. Intermediate the front and rear portions, the top panel should be curved generally to follow the shape of a wearer's head. The front and rear ends of each side panel may be pivoted respectively to said front and rear portions of the top panel. To ensure safety and reliability in use, a respective reinforcing element for example of metal may be provided in each of the front and rear portions of the top panel, each side panel then being pivoted to the reinforcing elements. Alternatively, the material of the front and rear portions may be of increased thickness, to give sufficient strength to the top panel.

As with the known forms of cyclists' helmets, the helmet of this invention may be made from a foamed plastics material and reinforcing bars, for example of a metal such as aluminium, titanium or stainless steel, may be embedded in that plastics material, during the course of manufacture by a moulding operation. Each reinforcing bar should extend along the length of the respective panel and, in the case of the side panels, that bar (or one of the bars, if there is more than one) may project from the ends of the side panel to form the hinge which connects the side panel the top panel.

Alternatively, each panel may be injection-moulded from a thermo-setting or thermo-plastic material; in this case, each panel may include one or more voids therein to reduce the weight thereof. A further possibility is for each panel to comprise a compound material, consisting of an outer injection-moulded shell and carrying an inner liner of a foamed plastics material adhered to the shell. The shell may include webs to impart sufficient rigidity thereto, in which case the foam liner may have recesses to accommodate those webs. Further, the inner profile of the foam liner may be moulded to suit different head sizes—for example, three different sizes of liner may be employed. Such a compound material may give advantageous properties as regards rigidity as well as impact resistance.

Preferably, the strap means has two strap parts disposed one towards the front and the other towards the rear of the helmet, each strap part being connected to the top panel and to the two side panels and each strap part serving to limit the relative separation of the side panels from the top panel. The two strap parts may be connected to the respective panels such that the parts converge below each side panel and come together somewhere below the ear of a wearer or near his chin. Preferably, a releasable buckle is provided, arranged to permit adjustment of the length of strap means, as with a conventional cyclists' helmet, to facilitate the fitting of a helmet to suit a wearer and the removal of the helmet when it is to be taken off.

By way of example only, three specific embodiments of cyclists' safety helmet of this invention will now be described in detail, reference being made to the accompanying drawings, in which.

Figure 2:
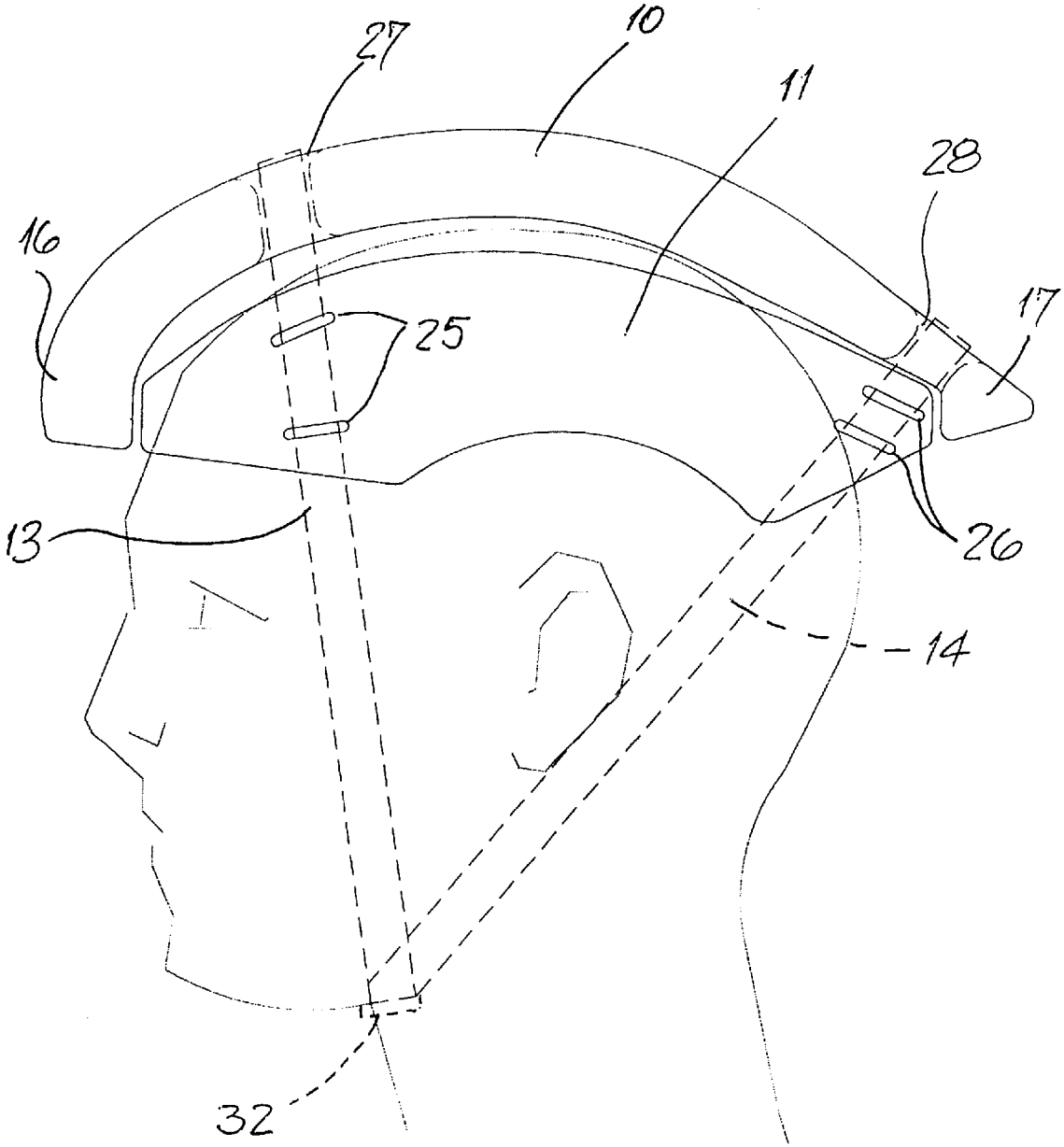
FIG. 2 is a side view of the helmet, again in place on a wearer's head.
Figure 4:
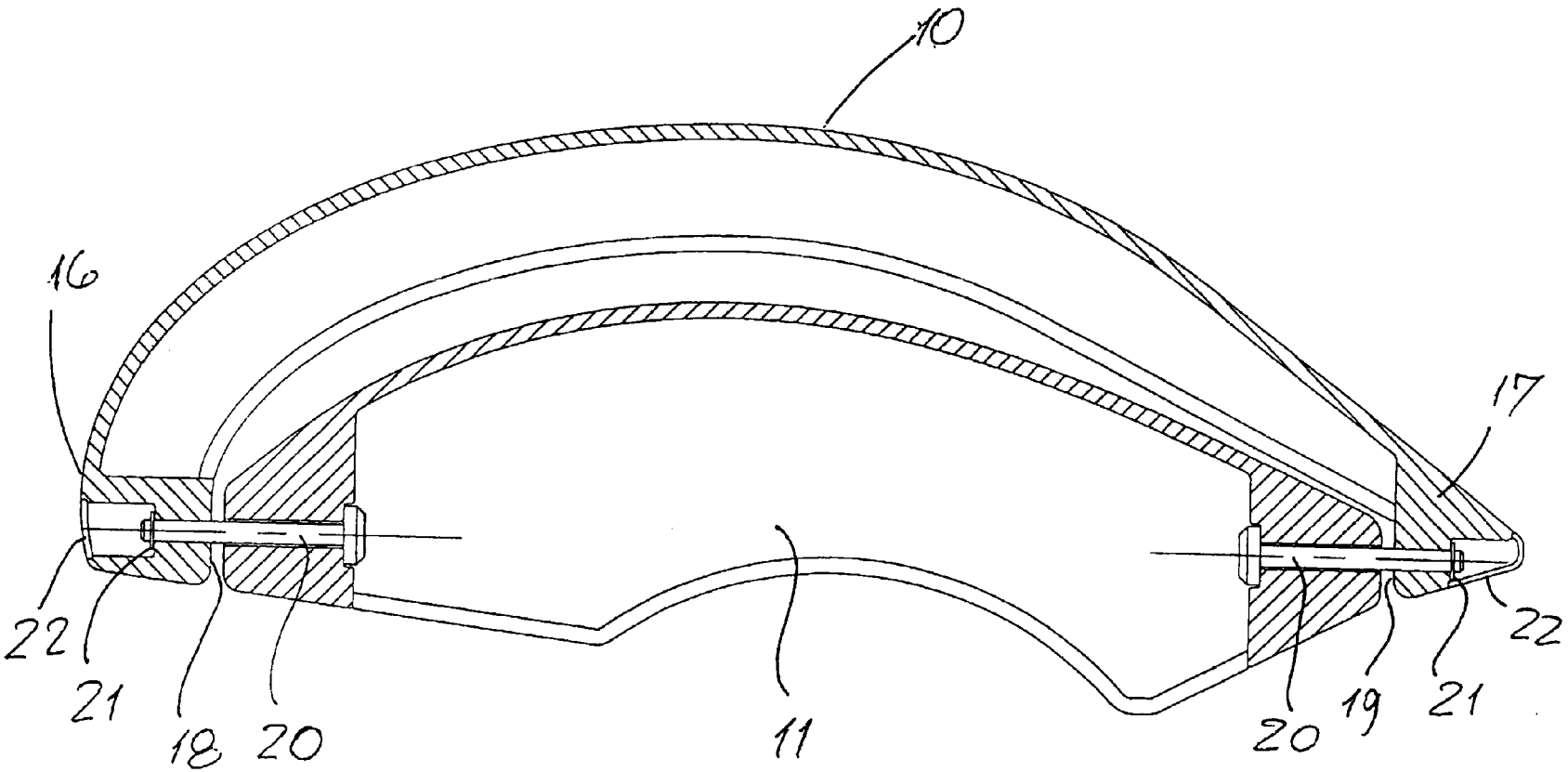
FIG. 4 is a longitudinal cross-section through the helmet of FIGS. 1 to 3.
Figure 6:
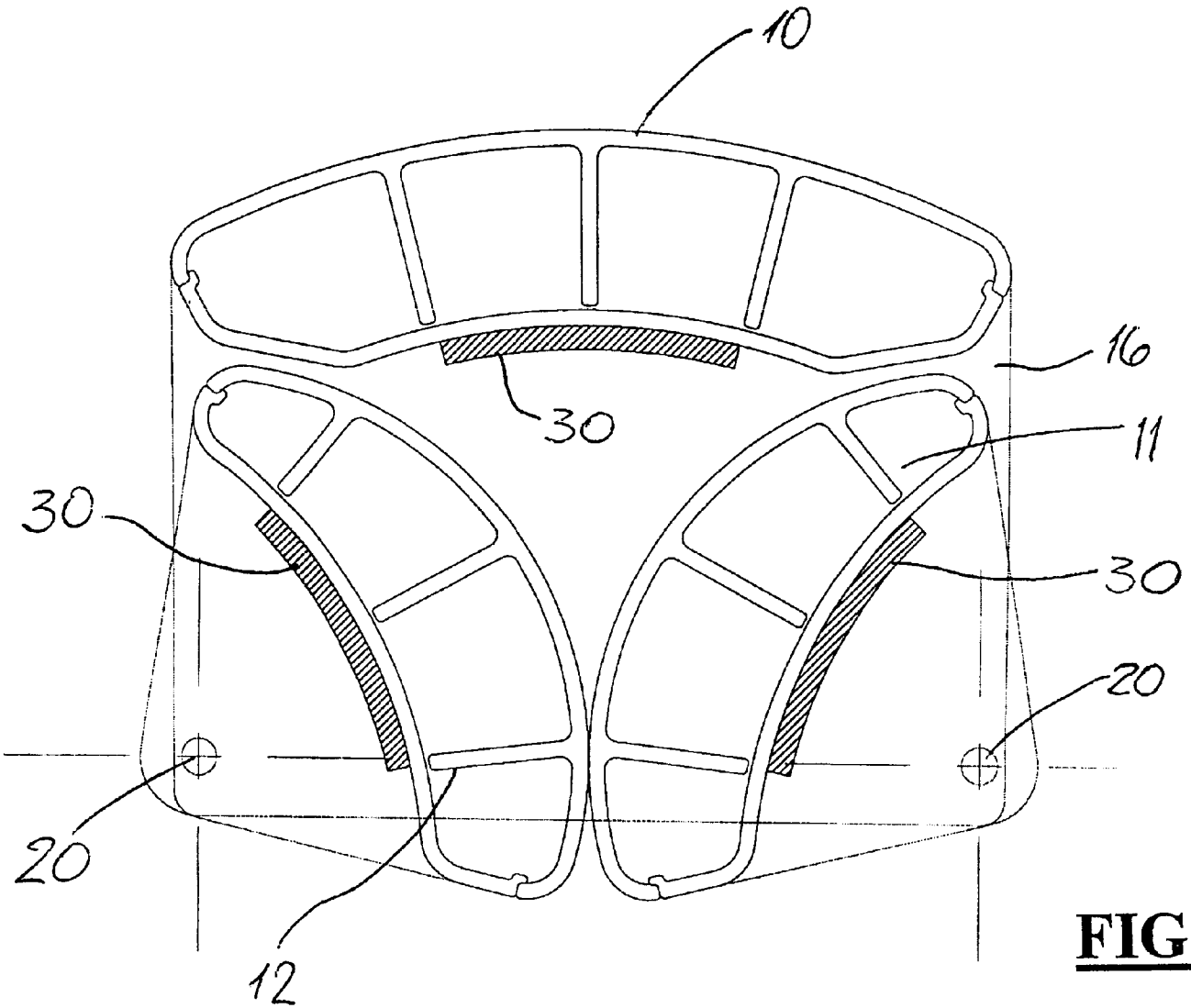
Figure 7:
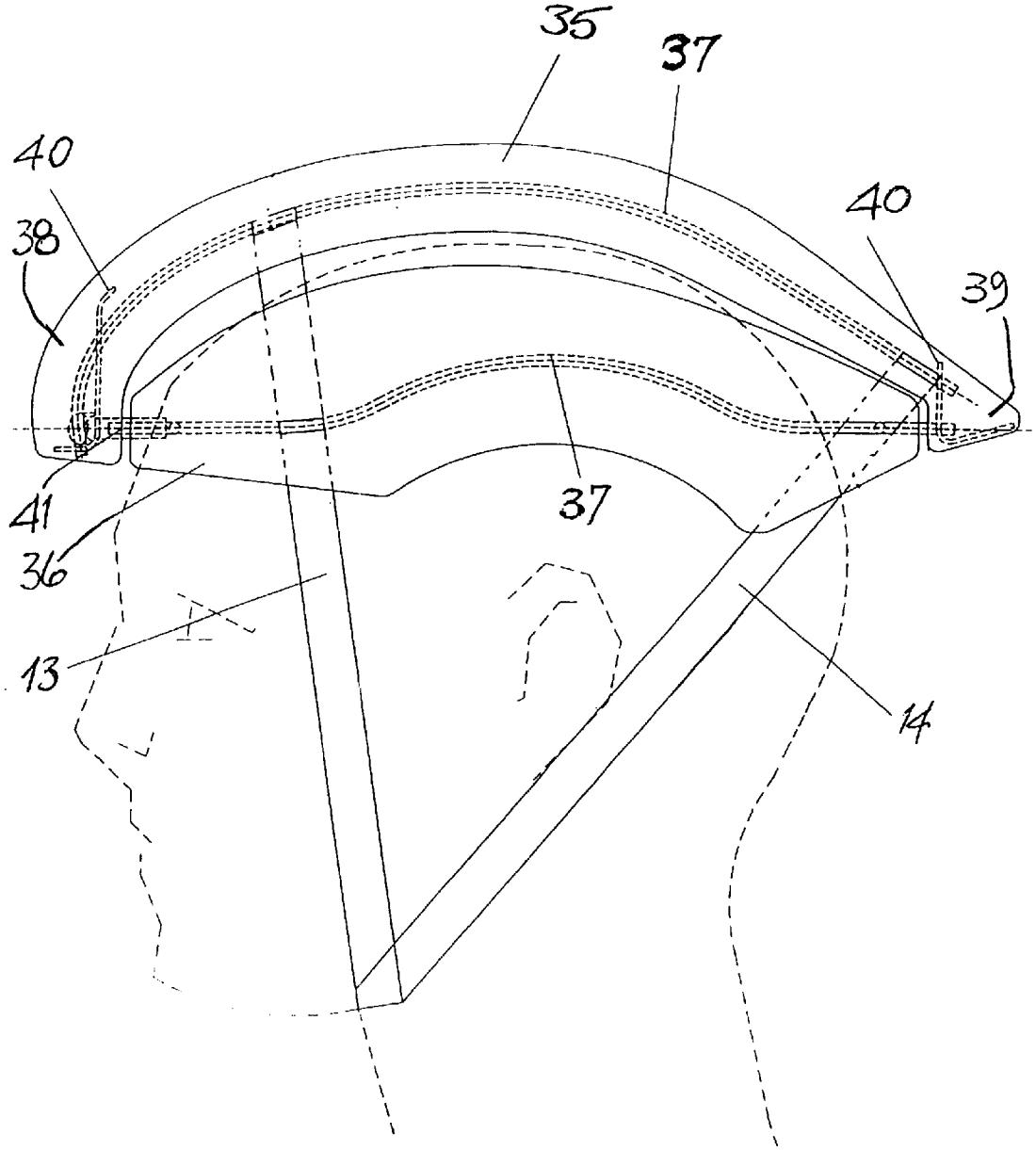
Figure 8:
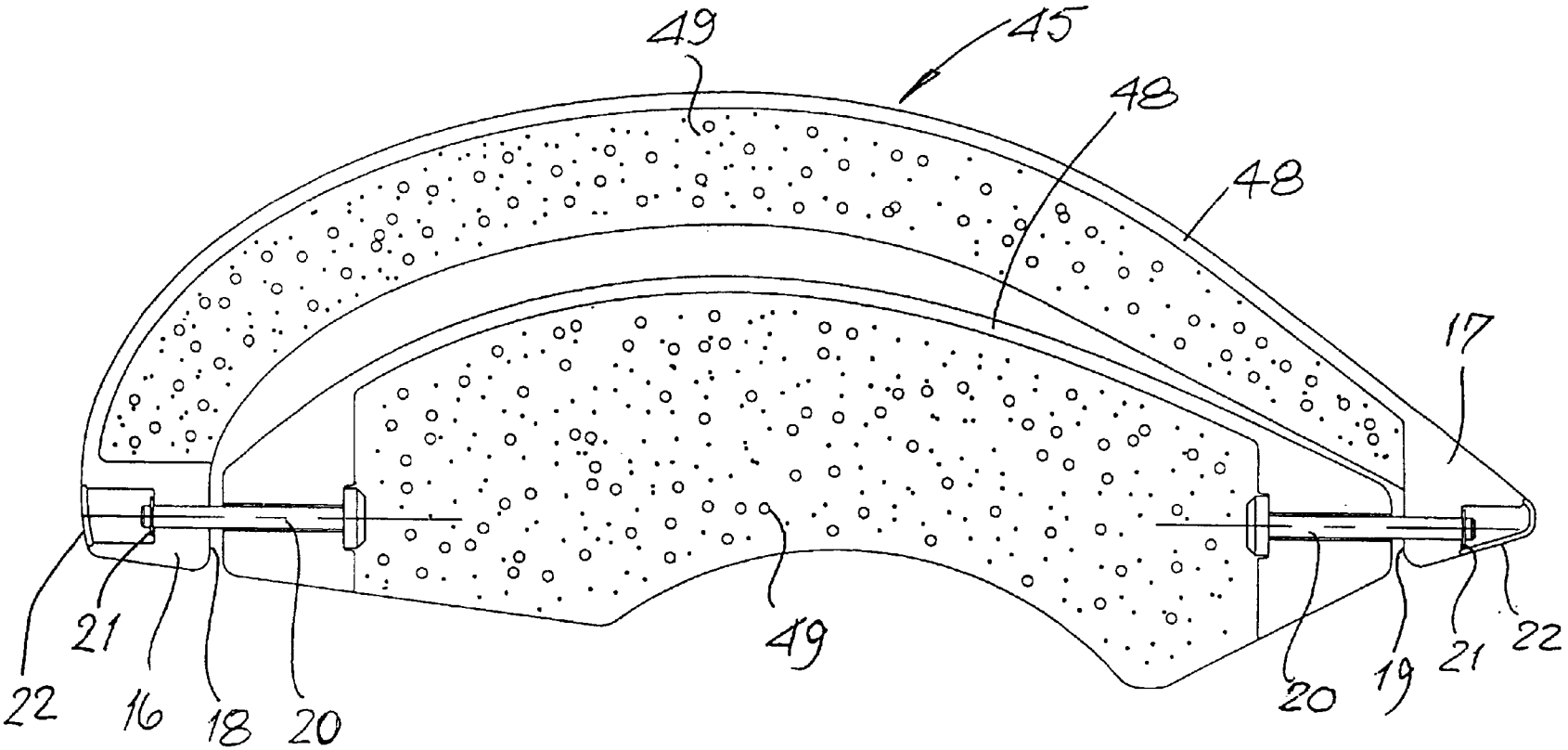
Figure 9:
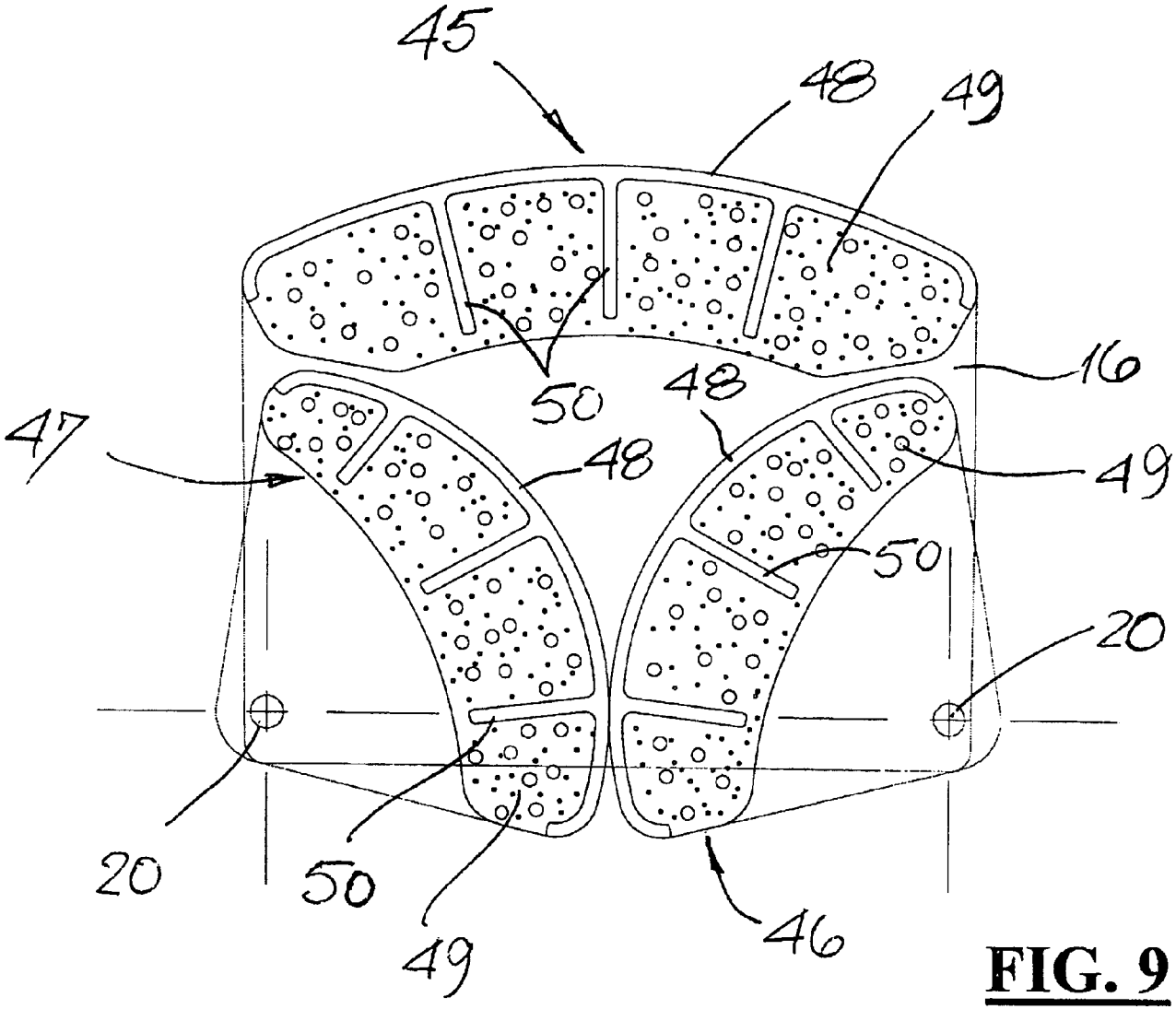

FIG. 6 diagrammatically shows both side panels moved fully to their folded positions;

FIG. 7 is a view similar to that of FIG. 2 but of a second embodiment of safety helmet;

FIG. 8 is a view corresponding to that of FIG. 4, but showing the third embodiment; and FIG. 9 illustrates the third embodiment in its folded condition.

The first embodiment of safety helmet shown in FIGS. 1 to 6 comprises a top panel 10, a pair of side panels 11 and 12 and a pair of straps 13,14, which are connected to the side panels 11,12 and also to the top panel 10. Each of the panels 10, 11 and 12 is injection-moulded from a thermo-setting plastics material such as polypropylene or a glass-reinforced nylon or acrylonitrile-butadiene-styrene,so as to be in the form of a hollow shell.

The top panel 10 is shaped to have a curved form overall, when viewed in longitudinal section (FIG. 4) and extends from an enlarged front portion 16 which overlies part of the forehead of a wearer to an enlarged rear portion 17 which overlies the back of the head of the wearer, to give an overall profile similar to that of a typical cyclist's helmet. The front portion 16 is essentially solid to give increased strength and defines an inwardly-directed substantially planar face 18. Similarly, the rear portion 17 also is essentially solid to give increased strength and defines an inwardly-directed substantially planar face 19.

Each side panel 11,12 is curved to fit round the sides of a wearer's head, each panel being injection-moulded from the same plastics material as the top panel and being in the form of a hollow shell but with end portions of increased thickness to impart sufficient strength thereto. Each side panel 11,12 is pivoted at its two ends by a respective pin 20 to the front and rear portions 16,17 of the top panel 10. The pins 20 are received in respective bores extending through the end portions of the side panels and the outer edges of the front and rear portions 16,17 of the top panel, the pins being retained in those bores by means of press-fit internally toothed retainers 21 such as those known as Starlock® fasteners. The exposed open ends of the bores in the top panel are closed by means of plastics cover strips 22.

Figure 1:
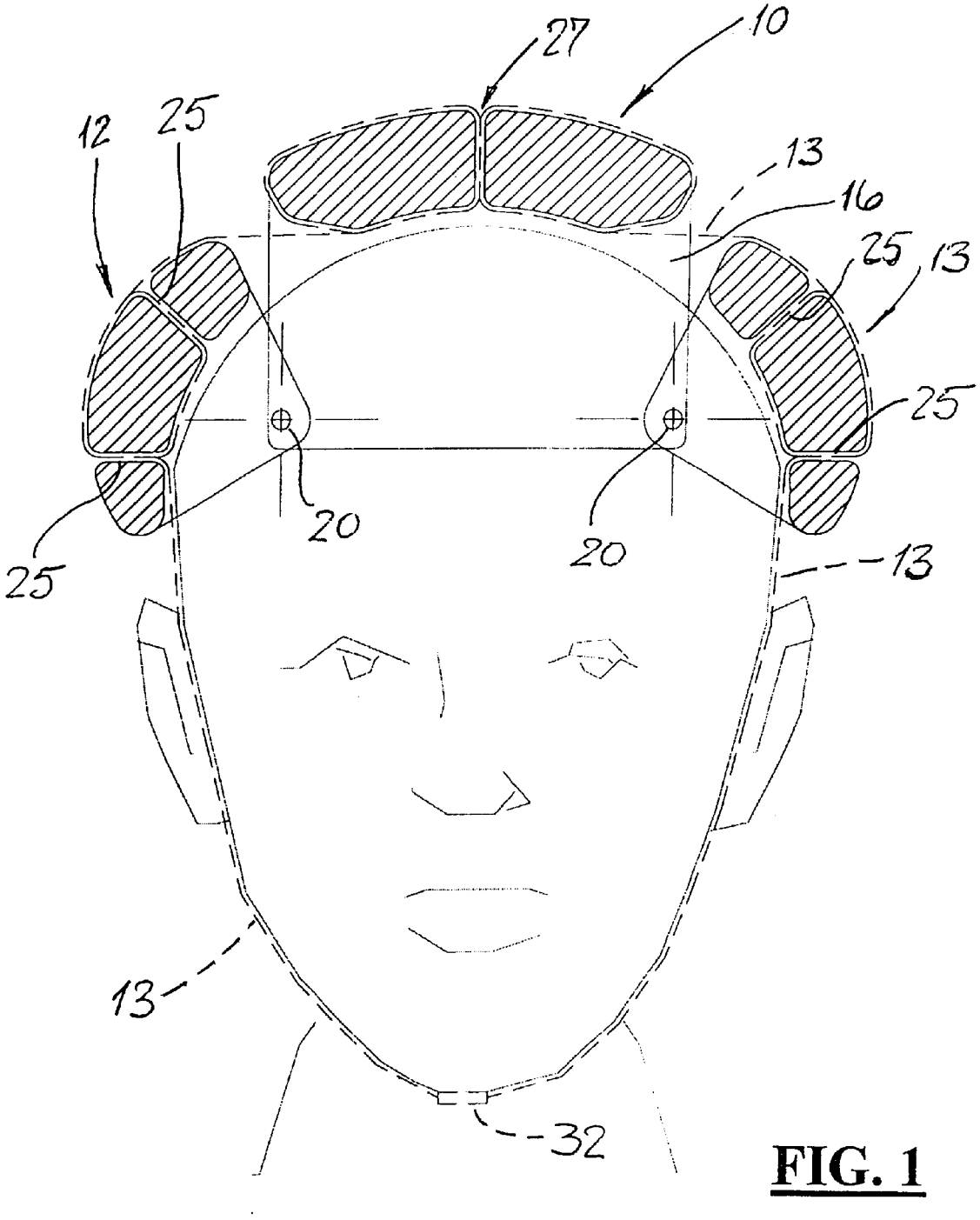
FIG. 1 is a diagrammatic front view, partly in section, of the helmet in place on a representation of a wearer's head.
Figure 5:
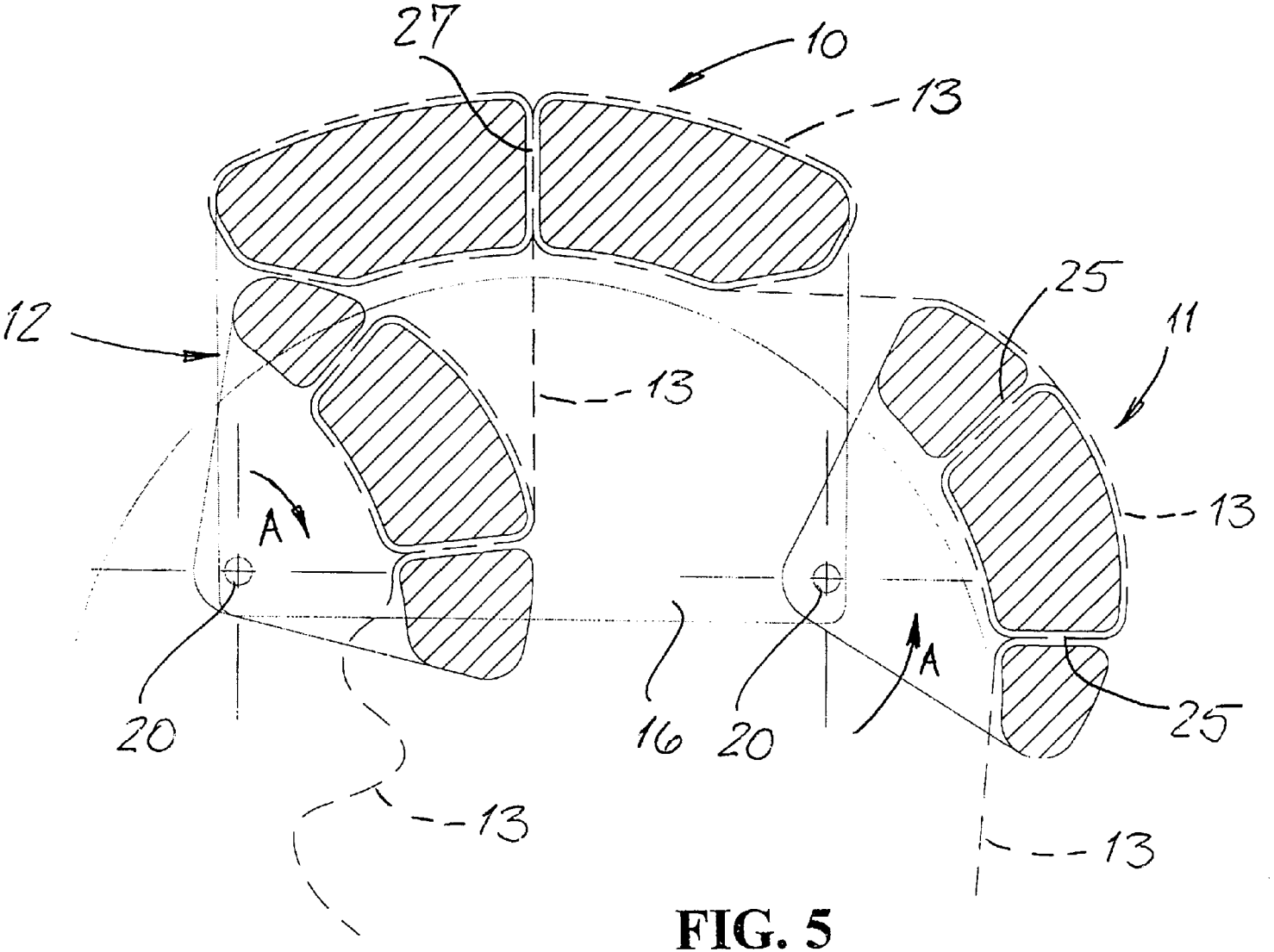
FIG. 5 is a transverse cross-section through the helmet of FIGS. 1 to 3, in the plane of one strap and with one of the side panels shown in its folded position.

As best appreciated from FIGS. 1, 5 and 6, the pivotal connections of the side panels 11,12 to the front and rear portions 16,17 of the top panel 10 are to the two sides of those portions 16,17 and near their free lower ends, so that the lateral spacing between the pivotal connections is slightly greater than the maximum radius of the two side panels, with respect to those pivots. Further, the distance between those pivotal connections and the central part of the top panel is also slightly greater than said maximum radius. This permits the two side panels to be pivoted from their positions shown in FIGS. 1 to 3, to the positions shown in FIGS. 5 and 6, by rotational movement in the direction of arrows A. When pivoted to those positions shown in FIG. 6 the overall volume of the folded helmet is only slightly greater than the overall volume of the top panel 10, considered by itself.

Figure 3:
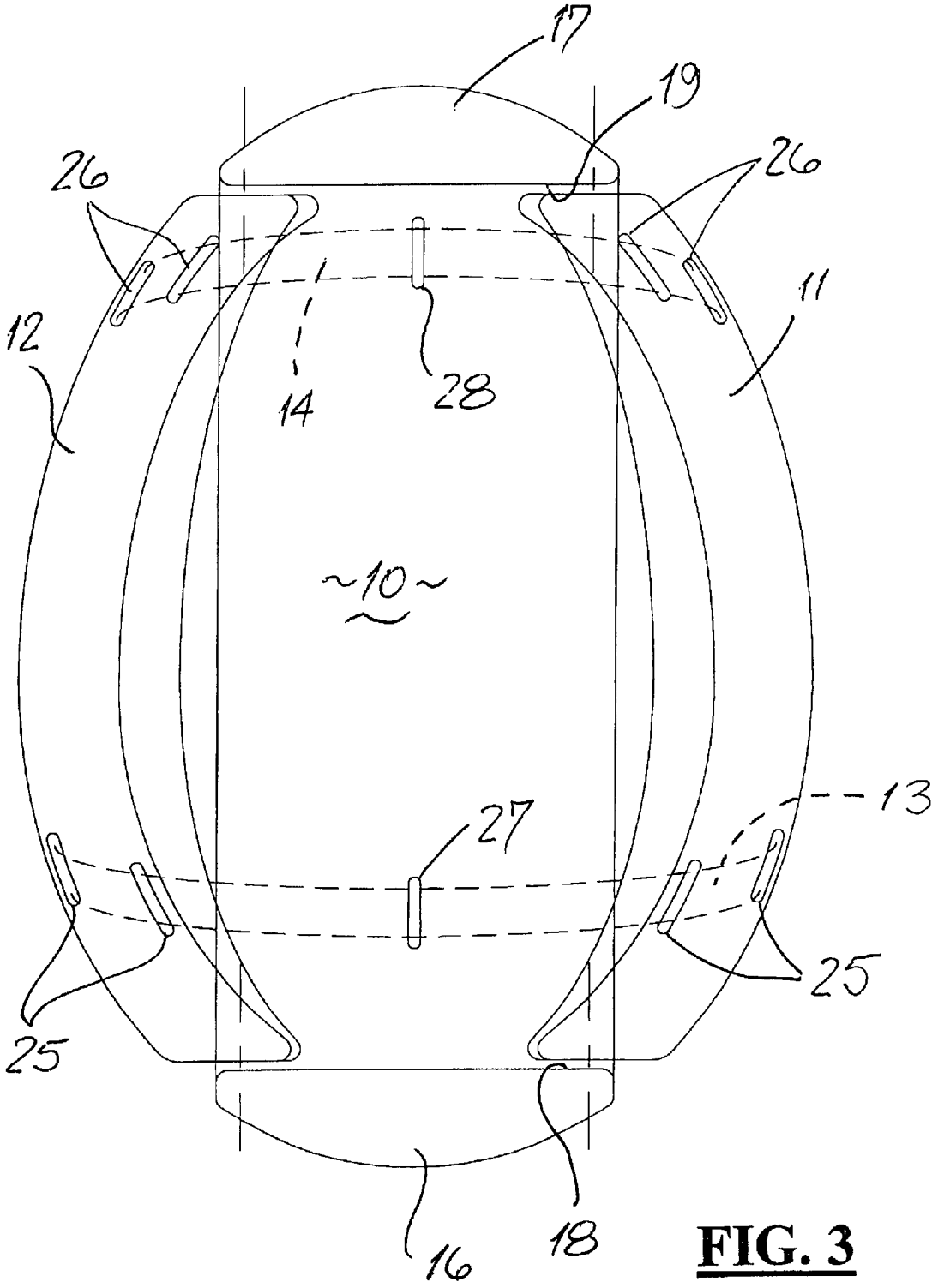
FIG. 3 is a plan view on the helmet of FIGS. 1 and 2.

As best seen in FIGS. 3 and 4, the end faces of each side panel are essentially planar and the length between those end faces is such that the side panel is a snug fit between the inwardly-directed faces 18,19 or the front and rear portions 16,17 respectively of the top panel. In this way, the side panels are properly located with respect to the top panel both when the helmet is opened out (FIG. 1) or folded (FIG. 6). However, there should be sufficient clearance to permit free pivoting movement without binding.

Referring now particularly to FIGS. 2, 3 and 5, it can be seen that each of the side panels 11,12 has two pairs of apertures 25,26 formed therethrough, one pair 25 towards the front of the side panel and the other pair 26 adjacent the rear thereof. The top panel has two apertures 27,28 formed centrally therethrough, aperture 27 being towards the front portion 16 of that panel and aperture 28 adjacent the rear portion 17. A pair of straps 13,14 extend through those apertures, threaded as best seen in FIGS. 1 and 5. Thus, each strap 13,14 is wrapped around the part of the side panel between the two apertures of each pair and through which the strap extends, and also is wrapped around the parts of the top panel to each side of the central aperture therethrough. By having the straps follow this path, the straps tend to bind to each of the panels to prevent slippage, whilst permitting relative pivoting movement between the top panel 10 and the side panels 11,12 between limits defined by the lengths of the straps. These should be set so that the opened-out limiting position is as shown in FIG. 1, and the fully folded limiting position is as shown in the left hand side of FIG. 5 and in FIG. 6.

The two straps on each side of the helmet are joined together at a buckle 32 which, in use, should be disposed beneath a wearer's chin as shown in FIG. 1. The effective length of the straps 13,14 should be adjustable, to accommodate heads of different sizes and permit the comfortable wearing of the helmet. Preferably, a quick-release buckle is provided to facilitate connection and release of the two strap parts.

Foam pads 30 are provided on the inner surfaces of the panels 10,11,12, to secure a comfortable fit for the wearer. Typically, the helmet would be supplied with several pads of different thicknesses, as with a conventional cyclist's helmet, and the user would select appropriate pads to stick inside the helmet at suitable positions to optimise comfort. Such an arrangement moreover has the advantage that it reduces the number of helmet sizes which must be made and stocked by a retailer since a suitable selection of pads permits one helmet to fit a significant range of head sizes.

It will be appreciated that once the helmet has been fully folded as shown in FIG. 6, the overall bulk of the helmet is very much less than when opened out ready for use as shown in FIGS. 1 to 3. This facilitates both easy storage and easy carrying of the helmet when not in use as a cyclist's helmet. By appropriate selection of the materials from which the helmet is made, despite its folding characteristics, it may be made to meet all applicable safety specifications for a cyclist's helmet.

Referring now to FIG. 7, there is shown a second embodiment of helmet of this invention. The top panel 35 and side panels 36 are moulded from a foamed plastics material such as polyurethane, polystyrene or acrylic foam. Each panel has embedded therein metallic reinforcing bars 37 for example of aluminium alloy, titanium or stainless steel, each bar extending for the full length of the panel. For clarity, only one reinforcing bar 37 is shown in each panel in FIG. 7, though it is anticipated three bars might be used in practice.

It would be possible to use other numbers of bars, consistent with the strength requirements for the helmet.

In order to give sufficient strength to the front and rear portions 38,39 of the top panel, metal plates 40 are embedded in the foamed plastics material. The reinforcing bars 37 of the top panel 35 are threaded into the embedded plates 40 in order to give sufficient rigidity to the top panel. In the side panels 36, the reinforcing bars 37 come together at the two ends of the respective panel and at the front of the helmet are crimped together in a ferrule 41 which projects out of the end of the side panel into the front portion 38 of the top panel. At the rear of the side panel, the reinforcing bar 37 simply projects beyond the end of the panel, into the rear portion 39 of the top panel. The ferrules 41 are pivoted in respective holes in the front plate 40 and the rear ends of the central reinforcing bars of the side panels are pivoted in respective holes in the rear plate 40. Each end of each side panel is also substantially planar and the length of each side panel is such that the planar ends fit reasonably closely to the inner faces of the front and rear portions 38,39 of the top panel 35.

The arrangement at the rear end of each side panel may be similar to that at the front end, for example using a ferrule to hold the bars together in a case having multiple bars in each side panel.

In other respects, the second embodiment is similar to that of FIGS. 1 to 6 and essentially the same advantages attach thereto. This second embodiment will not therefore be described in further detail here.

In FIGS. 8 and 9, there is shown a third embodiment of helmet of this invention and like parts are used to indicate like parts with those of the previous embodiments; those parts will not be described again here. The third embodiment differs in that each of the three panels 45, 46 and 47 are formed as a compound moulding, having a substantially rigid outer shell 48 to which is bonded a foam liner 49. Each panel shell 48 has longitudinally-extending reinforcing ribs 50 to give the completed panel sufficient strength, the foam liner 49 having corresponding recesses to accommodate those ribs. The end portions of the side panels 46 and 47, as well as the front and rear portions of the top panel 45 are formed from thickened regions of the shell material, to give sufficient strength to support the pivot pins 20.

Each outer shell may be made from a material such as polypropylene or a glass-reinforced nylon or acrylonitrile-butadiene-styrene; the liners may be made from material such as foamed polyurethane, foamed polystyrene or an acrylic foam.

The inner profile of each liner should be shaped to be a comfortable fit on the wearer's head. To this end, typically three different profiles may be used, in order to accommodate a wide range of head sizes, all using the same outer shell. In this case, it may be possible to dispense with the use of foam pads 30, though such pads may still be used to give a better fit for any given user.

Also, as will be appreciated from FIG. 9, the panels may have a slightly greater thickness than with the embodiment of FIG. 1. However, so long as the pivoting action can still be accommodated, as shown in FIG. 9, the same advantageous properties obtained by folding the helmet can still be achieved.

What is claimed is:

1. A safety helmet comprising a substantially rigid molded plastics elongate curved top panel adapted to extend over the crown of a wearer's head from front to back, a pair of substantially rigid molded plastics elongate side panels each adapted to extend around a respective side of a wearer's head, each side panel being separately pivoted at its two ends to the respective two ends of the top panel, the two pivotal connections of one side panel being displaced to one side of the center-line of the top panel and the two pivotal connections of the other side panel being displaced to the other side of the center-line of the top panel whereby the two side panels may be pivoted inwardly of the top panel so as lie mostly within a volume defined by the top panel, and strap means connected to the top panel and to each of the two side panels and adapted in use to extend under the chin of a wearer, the strap means serving to limit the relative separation of each of the two side panels from the top panel whilst permitting said inward pivoting of the side panels.

2. A safety helmet as claimed in claim 1, wherein the top panel has at its front end a front portion for extending partially over a wearer's forehead and at its rear end a rear portion for overlying the back of wearer's head, the ends of each side panel being pivoted respectively to the front and rear portions of the top panel.

3. A safety helmet as claimed in claim 1, wherein a respective reinforcing element is provided in each of the front and rear portions of the top panel, and the side panels are pivoted to said reinforcing elements.

4. A safety helmet as claimed in claim 3, wherein the reinforcing elements are of metal.

5. A safety helmet as claimed in claim 1, wherein each panel is molded from a foamed plastics material.

6. A safety helmet as claimed in claim 1, wherein each panel comprises a substantially rigid outer shell carrying an inwardly-directed liner of a foamed plastics material.

7. A safety helmet as claimed in claim 6, wherein the outer shell has longitudinally-extending reinforcing ribs, accommodated in recesses provided in the foamed plastics material.

8. A safety helmet as claimed in claim 6, wherein the foamed plastics material liner has an inner profile selected so that the helmet may suit a given head size of a wearer.

9. A safety helmet as claimed in claim 1, wherein each panel is injection-molded from a thermo-setting or thermoplastic material and includes voids therein to reduce the weight thereof.

10. A safety helmet as claimed in claim 5, wherein each panel includes at least one reinforcing bar extending therealong.

11. A safety helmet as claimed in claim 10, wherein each reinforcing bar is metallic.

12. A safety helmet as claimed in claim 10, wherein a reinforcing bar of each side panel projects from the ends of the panel and forms a hinge connecting the side panel to the top panel.

13. A safety helmet as claimed in claim 1, wherein a separate pivot pin is provided for each pivotal connection between the side panels and the top panel.

14. A safety helmet as claimed in claim 1, wherein the strap means has two strap parts disposed one to the front region and one to the rear region of the helmet and each strap part is connected to the top panel and to the two side panels so as to limit the relative separation of each of the two side panels from the top panel.

15. A safety helmet as claimed in claim 1, wherein the strap means is provided with a releasable buckle in the vicinity of the chin of a wearer which buckle permits separation of the strap into left and right hand parts.

* * * * *